US005561957A

United States Patent [19]

Gauthier

[11] Patent Number: 5,561,957

[45] Date of Patent: Oct. 8, 1996

[54] COMPOSITE WOOD-CONCRETE BUILDING MEMBER

[76] Inventor: Daniel Gauthier, St Vincent, de Pertignas, France

[21] Appl. No.: 204,582

[22] Filed: Mar. 2, 1994

[30] Foreign Application Priority Data

Mar. 3, 1993 [FR] France ..... 93 02733

[51] Int. Cl.[6] ..... E04B 5/26; E04C 5/18

[52] U.S. Cl. ..... 52/334; 52/332; 52/335; 52/405.3; 52/679; 52/687

[58] Field of Search ..... 52/318, 334, 447, 52/448, 351, 677, 679, 687, 335, 336, 323, 325, 332, 729.4, 737.4, 320, 405.1, 405.3

[56] References Cited

U.S. PATENT DOCUMENTS 4,841,703 6/1989 Grimaud .

FOREIGN PATENT DOCUMENTS 527716 3/1983 Australia .
1279771 2/1991 Canada .
0280228 8/1988 European Pat. Off. .
485367 1/1918 France .
726897 6/1932 France ..... 52/334
1093673 5/1955 France .
882553 7/1953 Germany .
3836592 5/1989 Germany .
6618059 6/1968 Netherlands .

*Primary Examiner*—Michael Safavi
*Attorney, Agent, or Firm*—Pearne, Gordon, McCoy & Granger

[57] ABSTRACT

Building or construction members are provided which include wooden girders or beams which form a framework onto which is molded a concrete plate or slab. A connection is formed between the beams and the concrete slab at least one sheet metal strip (4) having on one edge clips in the form of indentations (5) provided with teeth (6) and on the other edge with bent portions (9) constituting a flanged edge. On the flank of the sheet there are stamped portions (7) forming projections and cut portions (8) forming openings issuing onto the edge on which is formed the flanged edge (9). The indentations (5) provided with the teeth (6) are anchored in the beam (1), while the openings are permitting the passage and retaining of metal fittings (3). The flanged edges (9), the stamped portions (7) and the enlargements (8) participate in the anchoring of the metal sheet (4) in the concrete slab (2).

12 Claims, 1 Drawing Sheet

COMPOSITE WOOD-CONCRETE BUILDING MEMBER

BACKGROUND OF THE INVENTION

The present invention relates to the production of building or construction members constituted by wooden beams or girders forming a framework onto which is moulded a concrete slab or plate. It more particularly relates to the connection between the wooden beams or girders and the concrete slab or plate.

This composite wood-concrete construction is known. Generally a metal lattice embedded in the concrete slab ensures the resistance of the latter to perforation and to transverse bending stresses. Moreover, connectors fixed in the wood and concrete act in the manner of stirrups in a reinforced concrete beam preventing any displacement in the longitudinal direction of the beams.

Numerous improvements have been made to the junction between the various components of this type, particularly as a result of them being made from materials of different types.

Thus, the junction can be provided by vertical nails driven into the upper faces of the beams, the heads of said nails being embedded in the concrete.

Sheet metal plates fixed in the flanks of joists and cut so as to form teeth embedded in the concrete after traversing the shuttering have been used (POUTANEN-TUOMO-TAPANI EP-A1-104,629).

Another type of connection uses connectors formed from cylindrical tubes fixed in the upper face of the wooden beam (PARIS OUEST FR-A-2,611,778 and EP-A-280,228).

It is also known to use a sheet metal strip for providing a connection between two wooden beams. The metal sheet constitutes a core between the two beams in which it is fixed (FALKENBERG EP-B1-38,830).

Although these constructions bring about certain improvements in the prior art, they still suffer from disadvantages. In particular the use of metal sheets fixed in the flanks of joists leaves visible metal parts which is disadvantageous from the construction esthetic standpoint. In addition, teeth embedded in concrete do not constitute adequate connecting surfaces in order to withstand high longitudinal stresses.

The use of cylindrical connectors also requires fixing in the wood of a meticulous nature and may require the use of glue. A vertical sliding can also occur between the connector and the slab in the case of repeated alternating loads.

Generally there is no connection with the metal lattice or fittings embedded in the concrete. The use of presses liable to exert significant stresses for fixing the connectors in the wood can be prohibitive in certain cases, particularly when fixing must take place on site.

The storage and handling of beams with projecting connectors can be difficult both as a result of their fragility and as a result of work safety risks.

The object of the present invention is to obviate the aforementioned disadvantages of the prior art, so as to be usable without difficulty on the works site and without any major risks occurring during handling operations.

SUMMARY OF THE INVENTION

The building member according to the invention has in combination beams made from solid, laminated, glued, fibre-agglomerated or particle wood constituting the framework on which a concrete slab is moulded, metal fittings embedded in the concrete slab, connecting means between the beams, the concrete slab and the metal fittings. The connecting means includes at least one sheet metal strip having on one edge clips permitting the fixing of the sheet metal strip each of the beams, and on the flank and/or the other, means for the joining the sheet metal strip to the concrete plate and/or the metal fittings.

According to a preferred embodiment, the clips permitting the fixing of the sheet metal strip in each of the beams are produced on one of the edges of the sheet in the form of indentations, whose ends are provided with teeth.

The fixing of the sheet metal strip facilitated by the teeth made on the ends of the indentations takes place in the factory using a continuously operating press. These teeth can be coated with glue or resin so as to ensure a better connection to the wood. The profile of the teeth can favour the anchoring in the wood, particularly in the form of a hook permitting the closing of the slit made during fixing by the mere elasticity of the wood. Only the ends of the indentations penetrate the wood of the beams. The bases of the indentations are tangential to the surface of the beams, so that the thus created discontinuity prevents the wood cracking under the action of the metal sheet forming a wedge. This risk is very limited as a result of the fact that the sheet metal used is generally very thin and it is also possible to use wavy sheet metal, i.e. without any rectilinear cracking initiator.

Advantageously, the means ensuring the joining of the sheet metal strip to the concrete plate and the metal fittings are constituted by stamped and/or cut portions made on the flank of the metal sheet and/or issuing onto the edge opposite to that having the clips.

According to a preferred embodiment, the stamped portions made on the flank of the metal sheet are impressions forming projections stamped on one of the sides of the flank of the metal sheet.

Preferably the stamped and cut portions made on the flank of the metal sheet and issuing onto the edge opposite to that having the clips are openings permitting the passage and retaining of the metal fittings. According to a variant the stamped and/or cut portions are produced alternately on the two sides of the flank of the metal sheet.

These stamped portions, no matter whether they are produced on the same side of the sheet, or alternately on the two sides thereof, serve to increase the rigidity of the sheet and create anchoring points or zones for said sheet in the concrete. The cut portions permit the putting into place and holding of the metal fittings which are generally in the form of lattices. It is sufficient for the spacing of the cut portions of the enlargements to correspond with the meshes of the metal lattice in order to ensure the putting into place and holding. Although it is more practical to put the metal lattice into place after anchoring the sheet metal strip in the wood, in special cases the lattice can be positioned first, followed by the anchoring of the strip. In this case, the opening is oriented towards the bottom and is made in the top portion of the indentation, so as to permit the passage of the metal fittings.

The metal lattice embedded in the concrete slab or plate participates in the distribution of the stresses and forces withstood by the slab, particularly with respect to perforation and transverse bending.

According to an advantageous arrangement, the means ensuring the joining of the sheet metal strip to the concrete slab are constituted by bent portions forming a flanged edge on the edge opposite to that having the clips. The flanged edge is either produced on one side of the metal sheet, or alternately on the two sides. This bent portion also helps to rigidify the metal sheet. It is also indispensable on the works site for safety reasons, because it prevents a dangerous sharp edge. These bent portions can be produced in the factory, especially if the sheet metal strip used is not in the form of a roll, or can be produced on the site using a simple, robust manual bending tool.

According to a variant the metal sheet fixed in each of the beams and ensuring the joining thereof to the concrete slab and/or the metal fittings is a wavy sheet strip. The spacing of the undulations can be constant or variable. In the same way, the undulations can be parallel or convergent and in the latter case this improves the anchoring of the metal sheet in the concrete.

As stated hereinbefore the wavy sheet has the advantage of avoiding rectilinear wood cracking initiators. It also has a higher resistance to longitudinal compression and a better rigidity than a rectilinear sheet. For the same beam length, the wavy sheet is longer than the rectilinear sheet, so that its anchoring in the concrete of the plate or slab is better, with the stamped portions being the same.

According to a variant the connecting means constituted by at least one sheet metal strip are strips which are parallel to one another and fixed in each of the beams and ensuring their junction with the concrete slab and/or metal fittings.

The need to have several parallel sheet metal strips fixed in the same wooden beam is a function of the span of the beam and/or the load to be withstood by the slab. In general, two sheet metal strips in parallel are sufficient to increase the fixing in the wood and the anchoring in the concrete slab.

According to variants and in order to meet special requirements, these sheet metal strips could also be arranged in any other way, e.g. convergent or form with the wavy sheet strips non-parallel sinusoids.

The building member according to the invention is used for producing a composite wood-concrete floor, but the invention also covers the application thereof to the production of vertical or inclined panels. Within the framework of the latter application the panels are prefabricated prior to their fitting on site for use as building walls, the concrete plate then forming the outer face, the wooden beams then being either decorative or serve as a support for an internal coating. The space between the beams can be utilized for reinforcing the insulation of the thus formed wall and to permit the passage of all building hydraulic and electrical services. These panels can also be used for supporting the covering of a roof, the fitting of the concrete plate then being such as to position and avoid the sliding of e.g. channel tiles.

BRIEF DESCRIPTION OF THE DRAWINGS

The invention is described in greater detail hereinafter relative to an exemplified embodiment concerning the construction of a floor and with reference to the attached drawings, wherein show.

DETAILED DESCRIPTION OF PREFERRED EMBODIMENTS

Figure 1:
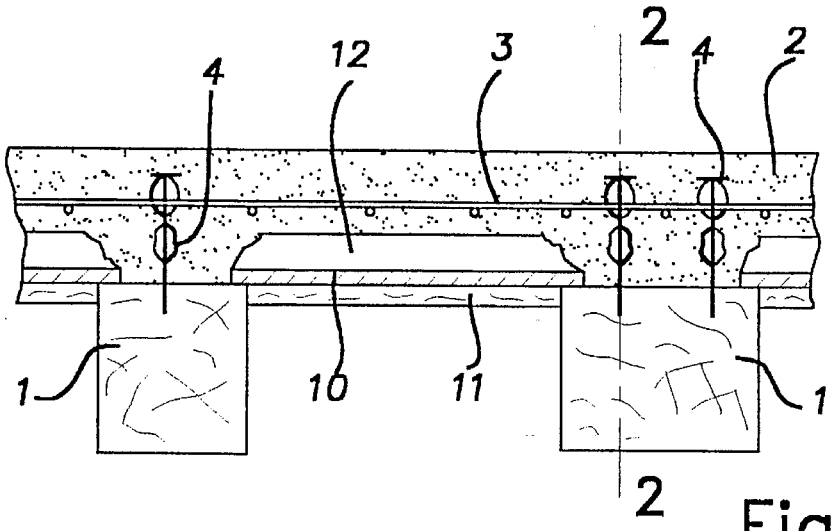
FIG. 1 a diagrammatic cross-sectional view of a floor according to the invention.

FIG. 1 shows the floor according to the invention in cross-section. The floor has beams 1 or joists made from solid wood with a height of 20 cm and a width of 12 cm. These solid wood beams can advantageously be replaced by glued, laminated wood or other derivatives such as fibres or particles of agglomerated woods. A sacrifice formwork 10 is supported by the beams. This formwork or shuttering can be replaced by a wain-scotting having a decorative effect. The wainscot 11 can be placed under the sacrifice formwork 10 according to a variant. A sound and heat insulating layer 12 is placed on the formwork. A metal lattice having metal fittings 3 of diameter 6 mm and mesh 100×200 mm is placed on the sheet metal strips 4 ensuring the connection between the wooden beams 1, the metal fittings 3 and the concrete slab 2 cast on the formwork constituted by the edge of the beams 1 and the sacrifice formwork 10.

Figure 2:
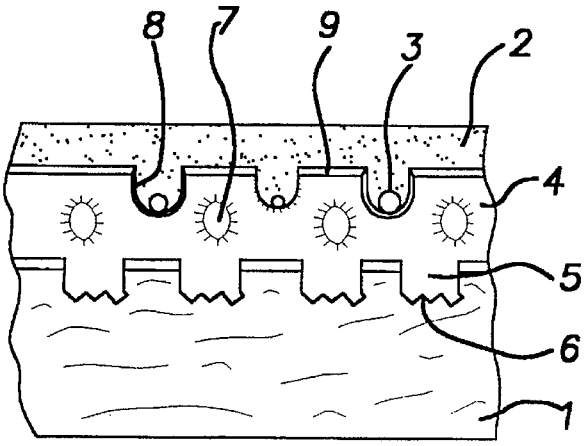
FIG. 2 a diagrammatic longitudinal sectional view of said floor taken along line 2—2 of FIG. 1.

As a function of the span of the wooden beam 1, its dimensions can be increased. Thus, in the right-hand part of FIG. 1 the width of the beam has been raised to 20 cm. In order to better ensure the connection between said beam 1 and the concrete slab 2, two parallel sheet metal strips 4 are fixed to the said beam. FIG. 2 diagrammatically shows a longitudinal section of the floor according to the invention. This section on the sheet metal strip 4 is only shown in cavalier perspective in FIG. 3. The sheet metal strip is of hot galvanized 8/10 mm thick steel in accordance with French Standard A 36,322, its height being 100 mm.

These dimensions vary in accordance with the span of the beams and the thickness of the concrete slab, so that the thickness can be 5 to 30/10 mm and its height 70 to 500 mm. This also applies for the same reasons with respect to the wooden beams and as a function of the nature of the wood, glued laminates allowing the greatest spans for the same dimensions, whereas other agglomerated wood types can generally only be used for small spans and are usually only employed for producing beams forming the framework of composite panels.

This sheet metal strip 4 is fixed in the wooden beam 1 with the aid of clips 5,6, whose indentations have an approximate height of 30 mm for a spacing of 100 mm corresponding to that of elongated openings 8, so as to permit the positioning of the fittings 3 of the metal lattice in the openings, where they are secured. In this example the metal lattice used has a mesh of 100×200 mm. It can be positioned in one or other direction in the openings 8 of the sheet metal strip 4.

Figure 3:
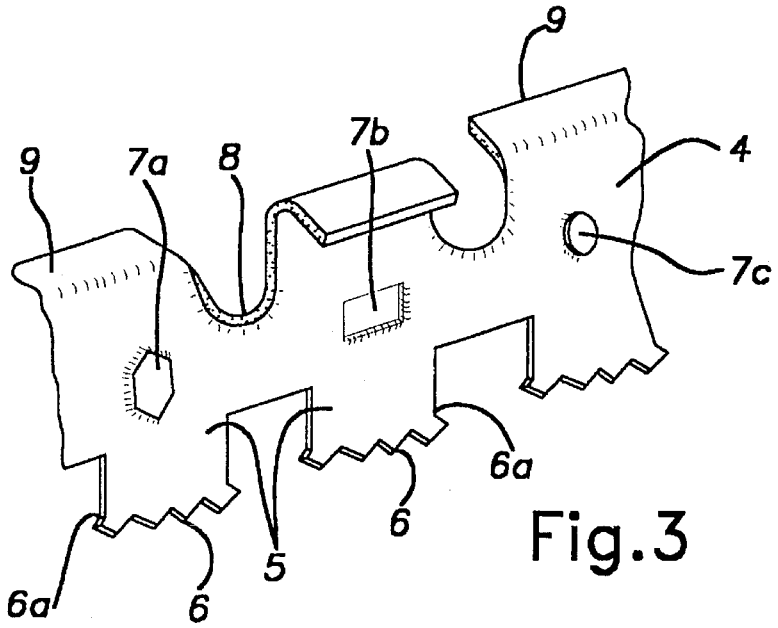
FIG. 3 a diagrammatic cavalier perspective view of a sheet metal strip ensuring the connection between the beam, the concrete slab and the metal fittings.

The sheet metal strip 4 is fixed in the factory using a continuously operating press. A similar press appropriate for use on the works site can also be envisaged, as a function of the site size. Thus, the indentations 5 are fixed in the wood by pressure exerted on the opposite edge, teeth 6 facilitating the penetration in the wood. These teeth can have special profiles in particular in the form of a hook *6a* ensuring a better anchoring as a result of the fact that the slit made in the wood after anchoring closes again as a result of the elasticity of the wood. The teeth 6 can also be coated with a glue or resin, for example SENCOTE (registered trademark), which facilitates the penetration of the tooth into the wood and after melting the adhesive due to the giving off of heat caused by the penetration reinforces the adhesion in the wood. This edge can be in the form shown in FIG. 3 after bent portions 9 of approximately 10 mm constituting flanged edges or can simply form a sharp edge and in this case the bent portions 9 are produced on site with the aid of a robust, easily used bending tool. These flanged edges increase the attachment in the concrete slab and can be used as control or setting guides for casting the concrete slab. They are also indispensable from a work safety standpoint, because they prevent any cutting edge being present prior to the casting of the concrete. In order not to create incipient cracks in the wood, the bases of the indentations 5 do not bear on the edge of the wooden beam 1. Therefore it is sufficient to place abutments on the press serving to fix the sheet metal strip 4, so as to limit the fixing depth. The openings 8 provided alternately on the two sides of the metal sheet are obtained by stamped portions having fillets, so as to rigidify the sheet and increase the attachment of the sheet 4 in the concrete slab 2. In FIG. 3 the openings 8 are level with the bases of the indentations 5 so as to permit the storage of the sheet metal strip 4 in roll form. It is obviously possible to position these openings 8 level with the teeth 6 of the indentations 5, so as to increase the longitudinal rigidity of the sheet 4. Stamped portions 7 with an approximate depth of 7 to 8 mm forming projections are stamped alternately on the two sides of the flank of the sheet metal strip 4. These stamped portions constituting impressions can be produced in different polygonal forms as shown in FIG. 3 with the lug having a hexagonal 7*a*, rectangular 7*b* or circular 7*c* section. It is clear that any other shape ensuring a good attachment of the metal strip 4 in the concrete slab 2 is also possible. Although not shown it is also possible to have preholes on the flank of the sheet in order to permit the passage of sheaths, wires and pipes.

The strip 4 can also be a wavy sheet metal strip. As indicated hereinbefore, this type of sheet prevents rectilinear wood cracking initiators, increases the anchoring surface in the concrete by offering a better resistance to compression.

As shown to the right in FIG. 1, the sheet metal strips 4 are arranged in parallel, rectilinear manner. Although parallel they could also be arranged in the form of sinusoids or any other curve. As a function of the particular needs, said strips could be positioned differently. They could e.g. be convergent or form non-parallel sinusoids or any other curve.

Thus, the floor produced according to the invention does not suffer from the disadvantages of the prior art. It has connecting means between the wooden beams, the concrete slab and the metal fittings permitting an excellent attachment between the beams and the slab, whilst also serving to support and maintain the fittings of the metal lattice. These connecting means are easy to produce and it is only necessary to have conventional pressing and stamping machines. Although the basic use of the composite wood-concrete building members according to the invention is the production of medium or large floors or panels for the construction of walls, numerous other embodiments can be envisaged. Thus, in the form of prefabricated members, it is possible to use them as self supporting frame members able to directly receive the roofing or for the construction of beams and lintels. They can also be used for producing fencing, urban fittings, walkways or can constitute pallets for packing containers. All these applications using such panel types fall within the scope of the present invention.

I claim:

1. Composite wood-concrete construction member comprising a concrete slab (2), beams or girders (1) made from wood, in solid, glued laminated, agglomerated fibre or particle form and constituting framework on which is moulded said concrete slab (2), metal fittings (3) embedded in said concrete slab, and sheet metal strips, at least one of said sheet metal strips (4) fixed to each of said beams, said sheet metal strips having clips (5–6) on one edge and inserted in the beams (1), said sheet metal strips also having joining means for joining the sheet metal strip (4) to at least one of the concrete slab (2) and the metal fittings (3).

2. The construction member according to claim 1, wherein the clips (5–6) are in the form of indentations (5), and ends of said indentations are provided with teeth (6).

3. The construction member according to claim 1, wherein the joining means includes at least one of stamped portions (7) and cut portions (8).

4. The construction member according to claim 1, wherein the joining means includes bent portions (9) forming a flanged edge on another edge of said sheet metal strip opposite the one edge of said sheet metal strip having the clips (5–6).

5. The construction member according to claim 1, wherein the joining means includes parallel sheet metal strips fixed in each one of the beams (1).

6. The construction member according to claim 1, wherein said joining means is on a flask of said sheet metal strip.

7. The construction member according to claim 1, wherein said joining means is on another edge of said sheet metal strip opposite said one edge with said clips.

8. The construction member according to claim 3, wherein said joining means is on at least one of a flank of said sheet metal strip and another edge of said sheet metal strip opposite the one edge of said sheet metal strip having the clips.

9. The construction member according to claim 3, wherein the joining means includes said stamped portions on a flank of said sheet metal strip.

10. The construction member according to claim 3, wherein said joining means includes said cut portions issuing onto another edge of said sheet metal strip opposite the one edge of said sheet metal strip having the clips.

11. The construction member according to claim 9, wherein the stamped portions (7) produced on the flank of the sheet metal strip are impression forming projections extending from one of the sides of the flank of the metal sheet.

12. The construction member according to claim 10 wherein the cut portions (8) issuing onto the another edge opposite the one edge of said sheet metal strip having the clips (5–6) are openings for passage and holding of the metal fittings (3).

* * * * *

UNITED STATES PATENT AND TRADEMARK OFFICE

CERTIFICATE OF CORRECTION

PATENT NO. : 5,561,957

DATED : October 8, 1996

INVENTOR(S) : Daniel Gauthier

It is certified that error appears in the above-indentified patent and that said Letters Patent is hereby corrected as shown below:

Item [57]

In the abstract, line 4, after "slab" insert --by--.

Column 2, line 6, after "strip" insert --in--; and
line 7, delete "the" (first occurrence).

Column 6, line 37 (claim 6, line 2), delete "flask" and insert --flank--; and
line 56, delete "impression" and insert --impressions--.

Signed and Sealed this

Twenty-fifth Day of February, 1997

Bruce Lehman

*Attest:*

BRUCE LEHMAN

*Attesting Officer*

*Commissioner of Patents and Trademarks*